US008899217B2

(12) United States Patent
Islas

(10) Patent No.: US 8,899,217 B2
(45) Date of Patent: Dec. 2, 2014

(54) BOWSTRING CAM ARRANGEMENT FOR COMPOUND LONG BOW OR CROSSBOW

(71) Applicant: Field Logic, Inc., Superior, WI (US)

(72) Inventor: John J. Islas, Baldwinsville, NY (US)

(73) Assignee: Field Logic, Inc., Superior, WI (US)

( * ) Notice: Subject to any disclaimer, the term of this patent is extended or adjusted under 35 U.S.C. 154(b) by 0 days.

(21) Appl. No.: 14/180,823

(22) Filed: Feb. 14, 2014

(65) Prior Publication Data

US 2014/0158105 A1 Jun. 12, 2014

Related U.S. Application Data

(63) Continuation of application No. 13/116,731, filed on May 26, 2011, now Pat. No. 8,651,095.

(60) Provisional application No. 61/356,109, filed on Jun. 18, 2010.

(51) Int. Cl.
*F41B 5/10* (2006.01)
*F41B 5/12* (2006.01)

(52) U.S. Cl.
CPC ..... *F41B 5/105* (2013.01); *F41B 5/123* (2013.01); *F41B 5/10* (2013.01); *Y10S 124/90* (2013.01)
USPC ..... 124/25.6; 124/88; 124/900

(58) Field of Classification Search
CPC ..... F41B 5/10; F41B 5/105; Y10S 124/90
USPC ..... 124/25.6, 88, 900
See application file for complete search history.

(56) References Cited

U.S. PATENT DOCUMENTS

| | | | | |
|---|---|---|---|---|
| 4,030,473 | A | 6/1977 | Puryear | |
| 4,192,281 | A | 3/1980 | King | |
| 4,287,867 | A * | 9/1981 | Islas | 124/25.6 |
| 4,401,097 | A * | 8/1983 | Simonds et al. | 124/25.6 |
| 4,457,288 | A * | 7/1984 | Ricord | 124/25.6 |
| 4,465,054 | A * | 8/1984 | Nishioka | 124/25.6 |
| 4,479,480 | A | 10/1984 | Holt | |
| 4,545,358 | A | 10/1985 | Collins | |
| 4,565,182 | A | 1/1986 | Barnett | |
| 4,587,944 | A | 5/1986 | Barnett | |
| 4,649,890 | A * | 3/1987 | Powers | 124/25.6 |
| 4,667,649 | A * | 5/1987 | Humphrey | 124/25.6 |
| 4,693,228 | A | 9/1987 | Simonds et al. | |
| 4,719,897 | A | 1/1988 | Gaudreau | |
| 4,757,799 | A * | 7/1988 | Bozek | 124/25.6 |
| 4,766,874 | A | 8/1988 | Nishioka | |

(Continued)

*Primary Examiner* — Gene Kim
*Assistant Examiner* — Alexander Niconovich
(74) *Attorney, Agent, or Firm* — Stoel Rives LLP

(57) ABSTRACT

A compound bow or crossbow employs bowstring cams with bowstring cam grooves and power cord cam grooves. Preferably a pair of generally identical power cord cam grooves are positioned axially above and below the bowstring cam groove. The power cords are anchored to a fixed anchor point, e.g., a pylon, on the near end of the riser or on the near side of the crossbow bar or stock. The power cords do not cross over to the other limb. The reduction in the number of cam wheels and pulleys and in the number of strings or cords results in greater efficiency and higher transfer of energy from the bow to the arrow or bolt. There is no drop-off in pull weight at full draw. The bolt or arrow accelerates throughout the travel of the bowstring, resulting in significantly higher velocity.

22 Claims, 3 Drawing Sheets

(56) References Cited

U.S. PATENT DOCUMENTS

| | | | | | |
|---|---|---|---|---|---|
| 4,781,168 | A | * | 11/1988 | Lester | 124/25.6 |
| 4,877,008 | A | | 10/1989 | Troubridge | |
| 4,942,861 | A | | 7/1990 | Bozek | |
| 5,024,206 | A | * | 6/1991 | Lester | 124/23.1 |
| 5,085,200 | A | | 2/1992 | Horton-Corcoran et al. | |
| 5,220,906 | A | | 6/1993 | Choma | |
| D337,145 | S | | 7/1993 | Horton-Corcoran | |
| 5,243,956 | A | | 9/1993 | Luehring | |
| 5,265,584 | A | | 11/1993 | Judson et al. | |
| 5,388,564 | A | * | 2/1995 | Islas | 124/25.6 |
| 5,408,982 | A | * | 4/1995 | Doornenbal | 124/23.1 |
| 5,445,139 | A | | 8/1995 | Bybee | |
| 5,522,373 | A | | 6/1996 | Barnett | |
| 5,596,976 | A | | 1/1997 | Waiser | |
| 5,598,829 | A | | 2/1997 | Bednar | |
| 5,630,405 | A | | 5/1997 | Nizov | |
| 5,649,520 | A | | 7/1997 | Bednar | |
| 5,884,614 | A | | 3/1999 | Darlington et al. | |
| 6,067,974 | A | * | 5/2000 | Islas | 124/25.6 |
| 6,073,351 | A | | 6/2000 | Barnett | |
| 6,095,128 | A | | 8/2000 | Bednar | |
| 6,098,607 | A | * | 8/2000 | Strother | 124/25.6 |
| 6,155,243 | A | * | 12/2000 | Gallops, Jr. | 124/25 |
| 6,205,990 | B1 | | 3/2001 | Adkins | |
| 6,286,496 | B1 | | 9/2001 | Bednar | |
| 6,425,386 | B1 | | 7/2002 | Adkins | |
| 6,470,870 | B1 | * | 10/2002 | Schaar | 124/25.6 |
| 6,474,324 | B1 | * | 11/2002 | Despart et al. | 124/25.6 |
| 6,571,785 | B1 | | 6/2003 | Choma | |
| 6,651,641 | B1 | | 11/2003 | Bower et al. | |
| 6,705,304 | B1 | | 3/2004 | Pauluhn | |
| 6,712,057 | B2 | | 3/2004 | Andrews | |
| 6,736,123 | B1 | | 5/2004 | Summers et al. | |
| 6,776,148 | B1 | * | 8/2004 | Islas | 124/25.6 |
| 6,786,214 | B2 | | 9/2004 | Andrews | |
| 6,792,931 | B1 | * | 9/2004 | Schaar | 124/25.6 |
| 6,799,566 | B1 | | 10/2004 | Malucelli | |
| 6,901,921 | B1 | | 6/2005 | Barnett | |
| 6,913,007 | B2 | | 7/2005 | Bednar | |
| 6,990,970 | B1 | * | 1/2006 | Darlington | 124/25.6 |
| 7,047,958 | B1 | * | 5/2006 | Colley | 124/25.6 |
| 7,174,884 | B2 | | 2/2007 | Kempf et al. | |
| 7,204,242 | B2 | | 4/2007 | Dziekan | |
| 7,305,979 | B1 | | 12/2007 | Yehle | |
| 7,328,693 | B2 | | 2/2008 | Kempf | |
| 7,363,921 | B2 | | 4/2008 | Kempf | |
| D589,578 | S | | 3/2009 | Choma | |
| D590,907 | S | | 4/2009 | Barnett | |
| 7,624,724 | B2 | | 12/2009 | Bednar et al. | |
| 7,624,725 | B1 | | 12/2009 | Choma | |
| 7,637,256 | B2 | * | 12/2009 | Lee | 124/25.6 |
| 7,677,233 | B2 | | 3/2010 | Bednar | |
| 7,708,001 | B2 | | 5/2010 | Kempf | |
| 7,743,760 | B2 | | 6/2010 | Woodland | |
| 7,748,370 | B1 | | 7/2010 | Choma | |
| 7,770,567 | B1 | | 8/2010 | Yehle | |
| 7,810,480 | B2 | | 10/2010 | Shepley et al. | |
| 7,836,871 | B2 | | 11/2010 | Kempf | |
| 7,997,258 | B2 | | 8/2011 | Shepley et al. | |
| 8,016,703 | B1 | | 9/2011 | Kronengold et al. | |
| 8,020,543 | B2 | | 9/2011 | Maleski et al. | |
| 8,033,275 | B2 | | 10/2011 | Bednar et al. | |
| 8,042,530 | B2 | | 10/2011 | Barnett | |
| 8,091,540 | B2 | | 1/2012 | Matasic et al. | |
| 8,104,461 | B2 | | 1/2012 | Kempf | |
| 8,240,299 | B2 | | 8/2012 | Kronengold et al. | |
| 8,387,603 | B2 | * | 3/2013 | Darlington | 124/25.6 |
| 8,522,762 | B2 | * | 9/2013 | Trpkovski | 124/25.6 |
| 8,578,918 | B1 | | 11/2013 | Islas | |
| 8,651,095 | B2 | * | 2/2014 | Islas | 124/25 |
| 2005/0022799 | A1 | | 2/2005 | Bednar | |
| 2007/0028907 | A1 | | 2/2007 | Bednar et al. | |
| 2008/0135032 | A1 | | 6/2008 | Islas | |
| 2009/0178657 | A1 | | 7/2009 | Shaffer | |
| 2009/0194086 | A1 | | 8/2009 | Kempf | |
| 2010/0012108 | A1 | | 1/2010 | Bednar et al. | |
| 2010/0031945 | A1 | | 2/2010 | Shaffer et al. | |
| 2010/0154768 | A1 | | 6/2010 | Bednar et al. | |
| 2010/0170487 | A1 | | 7/2010 | Kronengold et al. | |
| 2010/0170488 | A1 | | 7/2010 | Rasor et al. | |
| 2010/0186728 | A1 | | 7/2010 | Bednar et al. | |
| 2010/0269807 | A1 | | 10/2010 | Kempf | |
| 2011/0030666 | A1 | * | 2/2011 | Darlington | 124/25 |
| 2011/0203561 | A1 | | 8/2011 | Shaffer et al. | |
| 2011/0232619 | A1 | | 9/2011 | Bednar et al. | |
| 2011/0253118 | A1 | | 10/2011 | Kempf | |
| 2011/0308508 | A1 | * | 12/2011 | Islas | 124/25 |
| 2012/0006311 | A1 | | 1/2012 | Bednar et al. | |

* cited by examiner

BOWSTRING CAM ARRANGEMENT FOR COMPOUND LONG BOW OR CROSSBOW

RELATED APPLICATIONS

The present application is a continuation of U.S. patent application Ser. No. 13/116,731, entitled Bowstring Cam Arrangement for Compound Long Bow or Crossbow, which claims the benefit of Provisional Application Ser. No. 61/356,109, filed Jun. 18, 2010.

BACKGROUND OF THE INVENTION

This invention is directed to the field of archery, and more specifically to compound bows of the type employing cams and control cables to achieve a programmed draw weight, and the latter being variable with draw length. Applicant incorporates by reference prior U.S. Pat. No. 6,776,148 and other patents referred to in that document, that is, archery bows that have cams and power cords, and are programmed for optimal draw weight characteristics.

Typically, compound bows have means to regulate their draw weight so that a maximum pull weight is attained at an intermediate draw position, and with the draw weight dropping to some fraction of maximum pull weight at the full draw position.

It is also an objective of modern bows and crossbows to transfer to the bolt or arrow as much as possible of the energy that is stored in the bow, so that the projectile will fly faster and farther for a given draw weight. These goals have been difficult to achieve. Some inefficiencies are due to mechanical losses in the crossover strings and pulley mechanisms.

Unlike the prior designs, the present invention does not obtain the maximum draw weight at a partial draw position and then drop off draw weight at the full draw position. Instead, the bow or crossbow is designed so that draw weight increases continuously to full draw. This characteristic is required in some forms of long bow archery, and is useful in crossbow archery, because the crossbow has a mechanical release that holds the bowstring at full draw. Because the crossbow does not have to allow for drop-off of pull weight, there is no need for synchronizing cords or strings, and no need for cross-over strings.

BRIEF SUMMARY OF THE INVENTION

Accordingly, compound bow or crossbow of this invention employs bowstring cams with bowstring cam grooves and power cord cam grooves (either a single power cord cam groove or more preferably a pair of generally identical power cord cam grooves positioned axially above and below the bowstring cam groove). The power cords are anchored to a fixed anchor point, e.g., a pylon, on the near end of the riser or on the near side of the crossbow bar or stock. The power cords do not cross over to the other limb. The reduction in the number of cam wheels and pulleys and in the number of strings or cords results in greater efficiency (due to smaller mechanical losses) and higher transfer of energy from the bow to the arrow or bolt. The bolt or arrow accelerates throughout the travel of the bowstring, resulting in significantly higher velocity.

DETAILED DESCRIPTION OF A PREFERRED EMBODIMENT

Figure 1:
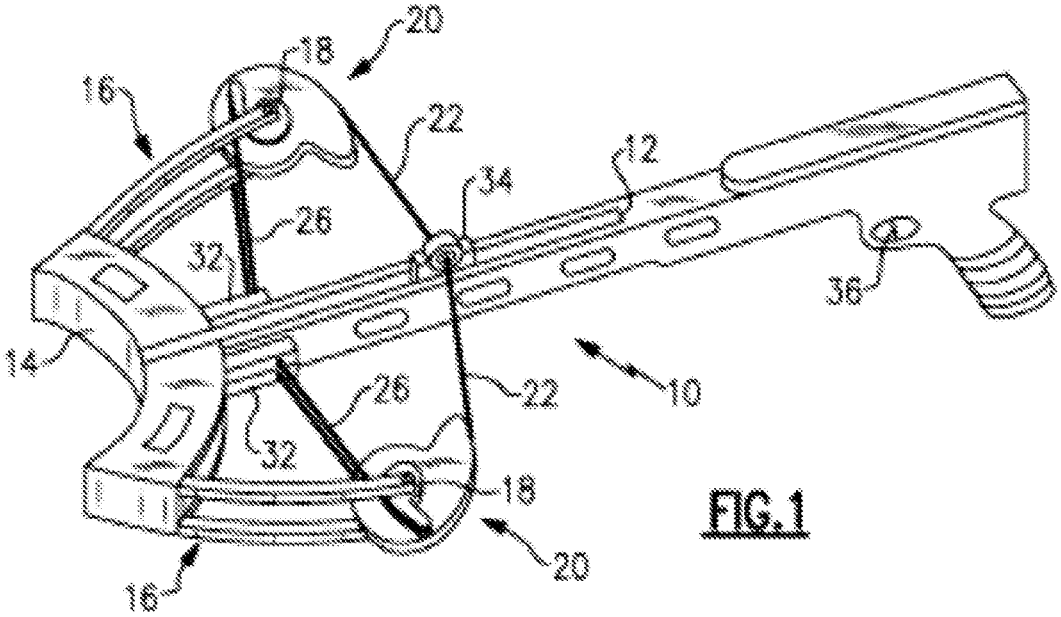
FIG. 1 is a perspective view of a crossbow embodying this invention.

The invention is explained in terms of a possible preferred embodiment, here a crossbow 10, in which there is an axial beam or stock 12 defining a medial plane with a riser 14 extending transversely at a front or distal end thereof. At each end of the riser 14 there is a power limb or spring limb 16, i.e., a spring limb at the right end of the riser and one at the left end. Each spring limb 16 has one end anchored to the riser and at its other end a pivot 18 in which a respective cam wheel 20 is supported. In this embodiment, the spring limbs 16 are formed of an upper portion and a lower portion, with the cam wheel 20 held in between them.

Note that in a crossbow, the riser extends horizontally or transversely, while in a long bow the riser extends vertically. The mechanics of operation are the same in either orientation.

Figure 4:
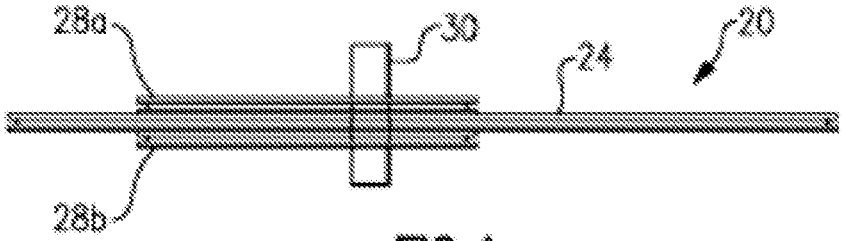
FIG. 4 is an edge-on view of the bowstring cam thereof.
Figure 2:
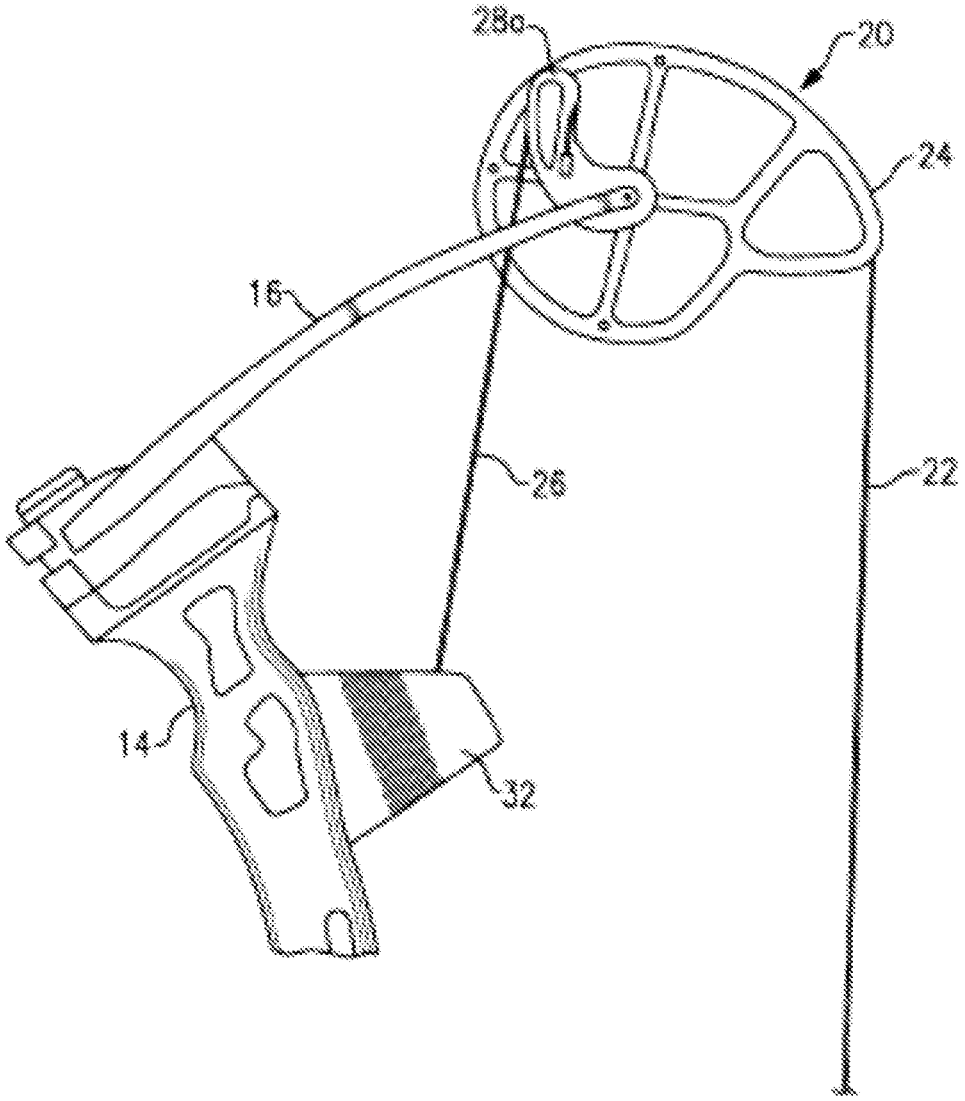
FIG. 2 is an plan view of the right limb thereof (the left limb being generally a mirror image of the right limb).
Figure 3:
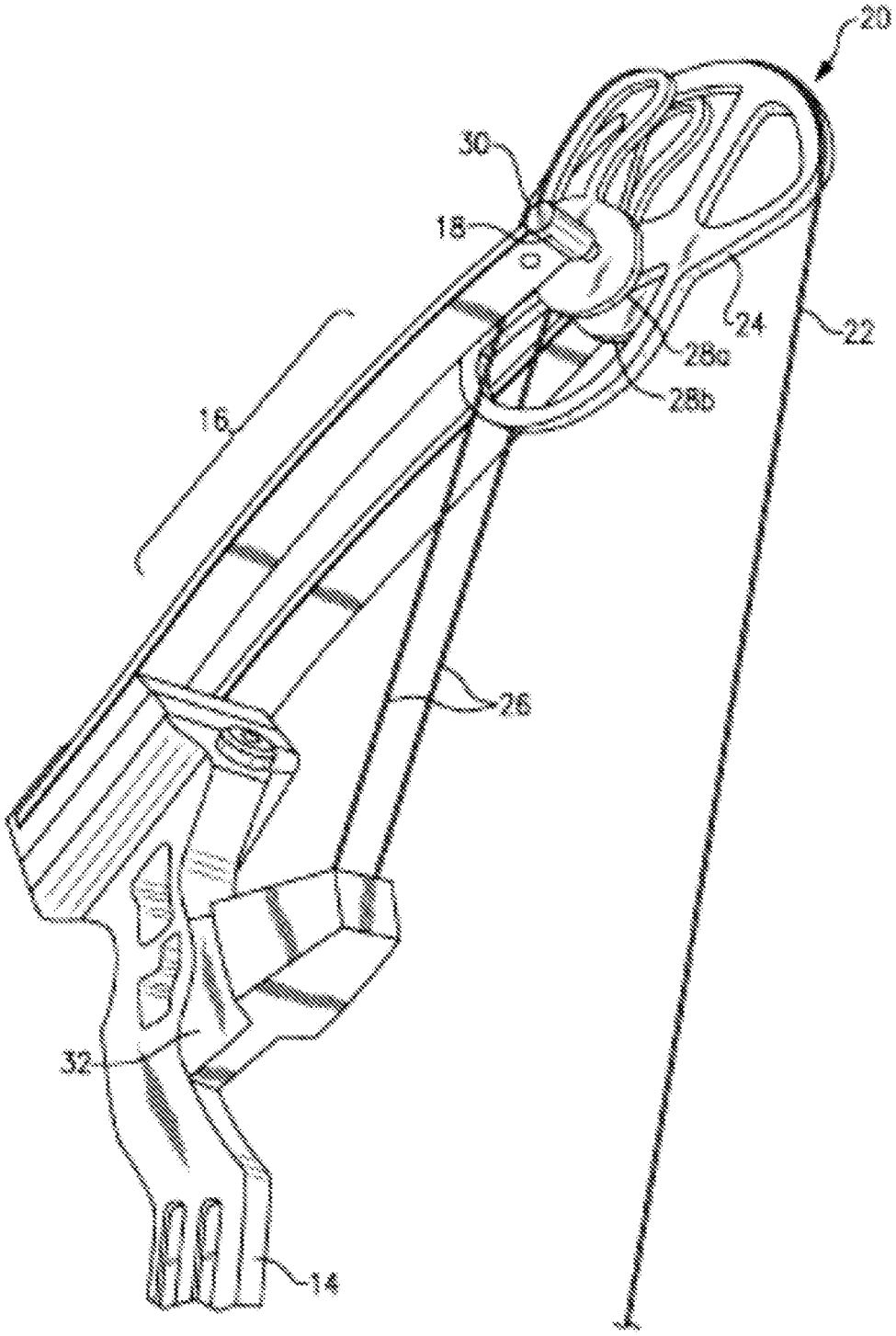
FIG. 3 is a perspective view thereof.

A bow string 22 is attached to each bowstring cam 20 and rides in a peripheral bowstring groove or channel 24 in each of these cams. In this invention there are no synchronizing pulleys nor any crossover cables. At each limb there are a pair of power cables 26 are reeved to respective power cable cam grooves 28*a* and 28*b* that are coaxial with the associated bowstring cam groove 24, and are situated axially above and below the same. These cam grooves 24, 28*a* and 28*b* are shown in relation to the axle 30 of the cam wheel 20 (See FIG. 4) The other ends of the power cables 26 are affixed at anchor points, here in the form of rigid pylons 32 affixed onto the riser, and projecting proximally (toward the archer position or handle end of the crossbow). In other possible embodiments, the anchor points may be on the beam or stock 12. Importantly, the power cords 26 do not cross the medial plane of the bolt or arrow, and do not travel against one another nor travel on or against any mechanical parts such as pulleys.

Also shown here is a traveling string release 34 mounted on a track on the top of the beam 12. This release can closed over the bow string and then cranked back to a full draw position by means of a screw or pulley mechanism (not shown). Many other cocking devices are possible. Also a finger trigger mechanism 36 is shown at a handle end of the stock.

While the invention has been described and illustrated in respect to a selected preferred embodiment, it should be appreciated that the invention is not limited only to that precise embodiment. Rather, many modifications and variations would present themselves to those of skill in the art without departing from the scope and spirit of this invention, as defined in the appended claims.

What is claimed is:

1. A pulley system for a bow having a riser with at least one limb attached at one end on each side of a medial plane of the riser, the pulley system comprising:

at least one cam pivotally mounted to a free end of each of the limbs on each side of the medial plane of the riser, each of the cams comprising a bowstring cam groove and upper and lower power cord cams located above and below the bowstring cam groove;

a bow string wound on the bowstring cam grooves and travels in the respective bowstring cam grooves to be wound and unwound therefrom; and upper and lower power cords having distal ends attached to fixed anchor points on the bow on opposite sides of the medial plane and wound on upper and lower power cord cam grooves of the upper and lower power cord cams, respectively, such that the upper and lower power cords do not extend across the medial plane to the riser, wherein the power cord cam grooves and the bowstring cam grooves are programmed such that the draw weight on the bow string increases from full brace position to full draw position without weight drop-off.

2. The pulley system of claim 1 wherein the upper and lower power cord cam grooves are configured to retain the upper and lower power cords out of a bowstring plane extending through the bowstring cam groove.

3. The pulley system of claim 1 wherein the upper and lower power cord cam grooves are configured to direct the upper and lower power cords away from a bowstring plane extending through the bowstring cam groove.

4. The pulley system of claim 1 wherein proximal ends of the upper and lower cords are attached to the upper and lower power cord cams, respectively.

5. The energy storage system of claim 1 wherein each of the limbs comprise first and second limbs arranged in a spaced apart configuration with the cams located between the pair of limbs, respectively.

6. The pulley system of claim 1 wherein the cams are not coupled by synchronizing cords or strings.

7. An energy storage system for a bow comprising:

a riser having a medial plane;

at least one limb attached to the riser on each side of the medial plane;

a cam pivotally mounted to a free end of each of the limbs on each side of a medial plane of the riser, each of the cams comprising a bowstring cam groove and upper and lower power cord cams located above and below the bowstring cam groove of the cam;

a bow string wound on the bowstring cam grooves and travels in the respective bowstring cam grooves to be wound and unwound therefrom; and upper and lower power cords having distal ends attached to fixed anchor points on the bow on opposite sides of the medial plane and wound on upper and lower power cord cam grooves of the upper and lower power cord cams, respectively, such that the power cords do not extend across the medial plane of the riser, wherein the power cord cam grooves and the bowstring cam grooves are programmed such that the draw weight on the bow string increases from full brace position to full draw position without weight drop-off.

8. The energy storage system of claim 7 wherein the upper and lower power cord cam grooves are configured to direct the upper and lower power cords away from a bowstring plane extending through the bowstring cam grooves.

9. The energy storage system of claim 7 wherein the upper and lower power cords minimize torsional deformation of the pairs of bow limbs as the bow string moves from a full brace position to a full draw position.

10. The energy storage system of claim 7 wherein each of the limbs comprise first and second limbs arranged in a spaced apart configuration with the cams located between the pair of limbs, respectively.

11. The energy storage system of claim 7 wherein the cams are not coupled by synchronizing cords or strings.

12. A method of configuring an energy storage portion for a bow comprising the steps of:

coupling at least one limb on each side of a medial plane of a riser;

attaching at least one cam to each of the limbs, each of the cams comprising a bowstring cam groove and upper and lower power cord cams located above and below the bowstring cam groove of the cam;

attaching distal ends of upper and lower power cords to fixed anchor points on the bow on opposite sides of the medial plane, so the upper and lower power cords are wound on upper and lower power cord cam grooves of the upper and lower power cord cams, respectively, such that the power cords do not extend across the medial plane of the riser; and attaching a bowstring to the bowstring cam grooves in the cams to be wound and unwound in the respective bowstring cam grooves, wherein the power cord cam grooves and the bowstring cam grooves are programmed such that the draw weight on the bow string increases from full brace position to full draw position without weight drop-off.

13. The method of claim 12 comprising the upper and lower power cord cam grooves directing the upper and lower power cords away from a bowstring plane extending through the bowstring cam groove.

14. The method of claim 12 comprising the upper and lower power cords minimizing torsional deformation of the pairs of bow limbs as the bow string moves from a full brace position to a full draw position.

15. The method of claim 12 comprising configuring each of the limbs as first and second limbs arranged in a spaced apart configuration with the cams located between the pair of limbs, respectively.

16. The method of claim 12 wherein the cams are not coupled by synchronizing cords or strings.

17. A bow comprising:

a riser with at least one limb attached at one end on each side of a medial plane of the rise;

at least one cam pivotally mounted to a free end of each of the limbs on each side of the medial plane of the riser, each of the cams comprising a bowstring cam groove and upper and lower power cord cams located above and below the bowstring cam groove;

a bow string wound on the bowstring cam grooves and travels in the respective bowstring cam grooves to be wound and unwound therefrom; and upper and lower power cords having distal ends attached to fixed anchor points on the bow on opposite sides of the medial plane and wound on upper and lower power cord cam grooves of the upper and lower power cord cams, respectively, such that the upper and lower power cords do not extend across the medial plane to the riser, wherein the power cord cam grooves and the bowstring cam grooves are programmed such that the draw weight on the bow string increases continuously to full draw.

18. The bow of claim 17 wherein the upper and lower power cord cam grooves are configured to retain the upper and lower power cords out of a bowstring plane extending through the bowstring cam groove.

19. The bow of claim 17 wherein the upper and lower power cord cam grooves are configured to direct the upper and lower power cords away from a bowstring plane extending through the bowstring cam groove.

20. The bow of claim 17 wherein proximal ends of the upper and lower cords are attached to the upper and lower power cord cams, respectively.

21. The bow of claim 17 wherein the cams are not coupled by synchronizing cords or strings.

22. The bow of claim 17 wherein the bow is one of a bow or a crossbow.

* * * * *